US006681874B2

(12) United States Patent
Risher et al.

(10) Patent No.: US 6,681,874 B2
(45) Date of Patent: Jan. 27, 2004

(54) METHOD AND APPARATUS FOR REMOVING FLUIDS FROM DRILL CUTTINGS

(75) Inventors: Owen Thomas Risher, Morgan City, LA (US); Nolan Joseph Fitch, Patterson, LA (US); Michael David Billeaud, Broussard, LA (US); David Jon Tilley, Franklin, LA (US); Ronald Charles Landry, Youngsville, LA (US)

(73) Assignee: Drill Cuttings Technology, L.L.C., Lafayette, LA (US)

( * ) Notice: Subject to any disclaimer, the term of this patent is extended or adjusted under 35 U.S.C. 154(b) by 80 days.

(21) Appl. No.: 10/055,561

(22) Filed: Jan. 23, 2002

(65) Prior Publication Data

US 2003/0136584 A1 Jul. 24, 2003

(51) Int. Cl.[7] ..... E21B 21/06

(52) U.S. Cl. ..... 175/66; 175/206; 175/207; 210/784; 210/808

(58) Field of Search ..... 175/66, 206, 207; 210/808, 780, 784

(56) References Cited

U.S. PATENT DOCUMENTS 1,524,916 A * 2/1925 Demme ..... 210/805
3,860,019 A * 1/1975 Teague ..... 134/109
4,222,988 A 9/1980 Barthel
4,255,269 A * 3/1981 Timmer ..... 175/66
4,539,102 A 9/1985 Boston et al.
4,599,117 A * 7/1986 Luxemburg ..... 134/25.1
4,639,258 A 1/1987 Schellstede et al.
4,836,302 A 6/1989 Heilhecker et al.
4,882,054 A 11/1989 Derrick et al.
4,915,850 A 4/1990 Onnes
4,942,929 A * 7/1990 Malachosky et al. ..... 175/66
5,454,957 A * 10/1995 Roff, Jr. ..... 210/768
5,839,521 A 11/1998 Dietzen
5,913,372 A 6/1999 Dietzen
6,009,959 A 1/2000 Dietzen
6,170,580 B1 1/2001 Reddoch
6,179,070 B1 1/2001 Dietzen
6,213,227 B1 4/2001 Dietzen
6,258,282 B1 * 7/2001 Strid et al. ..... 210/780
6,279,471 B1 8/2001 Reddoch
6,506,310 B2 * 1/2003 Kulbeth ..... 210/780

* cited by examiner

*Primary Examiner*—Hoang Dang
(74) *Attorney, Agent, or Firm*—Ted M. Anthony

(57) ABSTRACT

A method and apparatus is provided for removing fluids, particularly entrained and/or adherent fluids, from drill cuttings generated during the well drilling process. A generally cylindrical wire-wrapped screen having a bore therethrough rotates about its longitudinal axis. Suction pressure is applied through the inner bore of the cylindrical wire-wrapped screen. As fluid-laden drill cuttings are deposited on the outer surface of the cylindrical wire-wrapped screen, fluids are drawn off of the cuttings and evacuated from the inner bore of the cylindrical wire-wrapped screen. Solid components of the cuttings remain on the outer surface of the cylindrical wire-wrapped screen and eventually roll off the screen. A scraping member is provided to agitate cuttings deposited on the outer surface of the cylindrical wire-wrapped screen.

40 Claims, 4 Drawing Sheets

METHOD AND APPARATUS FOR REMOVING FLUIDS FROM DRILL CUTTINGS

CROSS REFERENCES TO RELATED APPLICATIONS

NONE

STATEMENTS AS TO RIGHTS TO INVENTIONS MADE UNDER FEDERALLY SPONSORED RESEARCH AND DEVELOPMENT

NONE

INVENTORS
OWEN THOMAS RISHER
NOLAN JOSEPH FITCH
RONALD CHARLES LANDRY
MICHAEL DAVID BILLEAUD
DAVID JON TILLEY

BACKGROUND OF THE INVENTION

1. Field of the Invention

The present invention relates generally to the treatment of drill cuttings generated during oil and gas well drilling operations. More particularly, the present invention relates to a method and apparatus for the removal of fluids, such as drilling mud, mud additives and contaminants, from drill cuttings. More particularly still, the present invention relates to a method and apparatus for the separation of entrained and/or adherent fluids from drill cuttings, thereby permitting recovery of such fluids as well as efficient disposal of the solid components of said drill cuttings.

2. Description of the Related Art

Drilling rigs used for the drilling of oil and gas wells typically include a supportive rig floor positioned over a well, a derrick extending vertically above said rig floor, and a traveling block which can be raised and lowered within said derrick. During drilling operations, a drill bit is generally conveyed into a well and manipulated within said well via tubular drill pipe. The drill pipe is raised and lowered within the well utilizing the drilling rig derrick.

When installing drill pipe or other tubular pipe into a well, such pipe is typically installed in a number of sections of roughly equal length called "joints". As such pipe penetrates farther and farther into a well, additional joints of pipe must be added to the ever lengthening "string" or "drill string" in the rig derrick. Thus, a typical drill string comprises a plurality of sections or joints of pipe, each of which has an internal, longitudinally extending bore. During drilling operations, a drill bit or other desired equipment is typically attached to the lower or distal end of said drill string.

During drilling operations, a fluid known as drilling mud or drilling fluid is normally pumped down the longitudinally extending bore of the tubular drill pipe, and circulated up the annular space which is formed between the external surface of said drill pipe and the internal surface of the wellbore. The basic functions of drilling mud are: (1) to cool and lubricate the drill bit and downhole equipment during drilling operations; (2) to transport pieces of drilled-up rock and other debris from the bottom of the hole to the surface; (3) to suspend such rock and debris during periods when circulation is stopped; (4) to provide hydrostatic pressure to control encountered subsurface pressures; and (5) to seal the porous rock in the well with an impermeable filter cake.

As circulated drilling mud returns to the earth's surface and is pumped out of a well, the mud often contains pieces of broken, drilled-up rock and other solid debris known as "cuttings" or "drill cuttings". In most cases, an effluent mud stream flowing out of a well, together with associated drill cuttings, is directed to one or more devices which are specifically designed to separate such drill cuttings from the mud. Such devices include, but are not limited to, "shale shakers," desanders, desilters, hydrocyclones and centrifuges.

Shale shakers, which are well known in the art, are essentially screens that are used to separate drill cuttings from the drilling mud. In many cases, shale shakers utilize a series of screens arranged in tiered or flat disposition relative to each other. Further, such screens are often made to vibrate in order to increase the quality of such separation. The bulk drilling mud falls through the screens by gravity, while the predominantly solid cuttings pass over the end of the screens. Certain shale shakers are designed to filter coarse material from the drilling mud, while other shale shakers are designed to remove finer particles from the well drilling mud.

Shale shakers and other cuttings-removal equipment perform a valuable function in the overall drilling process. If drill cuttings are not removed from the effluent mud stream as such mud is circulated out of a well, said cuttings would remain in the active mud system. These drill cuttings and other debris would then be recirculated into the well. This often leads to problems, because such drilled solids can dramatically alter the characteristics and performance of the drilling mud. Further, recirculation of drill cuttings can also increase wear in mud pumps and other mechanical equipment used in the drilling process. As such, shale shakers and other similar devices are frequently necessary to efficiently separate drill cuttings from drilling mud as it is circulated out of a well.

Once drill cuttings and other debris have been separated from the bulk mud stream flowing out of a well, it is necessary to dispose of such cuttings. Unfortunately, in most instances the disposal of drill cuttings can present a number of different problems. Often, the most economical way to dispose of drill cuttings would simply be to discharge said cuttings directly into the surrounding environment. However, even though drill cuttings leaving a shale shaker have been separated from a well's effluent mud stream, such cuttings nonetheless typically include entrained and/or adherent mud and other fluids which could be damaging to the environment.

In order for drilling mud to accomplish its intended objectives, it is often necessary to adjust or control certain characteristics of such drilling mud. Thus, chemicals and/or other additives are often mixed into such drilling muds. Common drilling mud additives include gelling agents (e.g., colloidal solids and/or emulsified liquids), weighting materials, and other chemicals which are used to maintain mud properties within desired parameters. Further, although drilling mud has historically been water-based, improved results have been obtained using oil-based or synthetic-based muds, especially in severe drilling environments. Many of these additives, oil-based muds and synthetic-based muds can be environmentally harmful. Thus, it is often undesirable and a violation of environmental regulations to release such fluid-laden cuttings directly into the surrounding environment.

In order to avoid environmental contamination and comply with applicable governmental regulations, drill cuttings are frequently transported from a drilling rig to an off-site facility for disposal. In order to accomplish such off-site disposal, drill cuttings are generally loaded into boxes or other storage containers for transportation away from the rig. While this solution can be generally functional, it is not without significant problems.

One major problem associated with the off-site disposal of drill cuttings is increased cost. In most cases, special equipment is needed to move fluid-laden drill cuttings from a rig's shale shakers to another location on the rig where storage boxes are loaded. Such equipment is often in the form of complicated and elaborate conveyors, augers and/or vacuum units. Moreover, large numbers of storage boxes must be rented or purchased in order to accommodate such cuttings. All of this added equipment and labor increases the costs associated with the drilling process.

Another major problem associated with off-site disposal of fluids-laden drill cuttings is the use of valuable rig space. Space is at a premium on most drilling rigs, and particularly those that work in a marine environment. In most instances, cuttings disposal equipment takes up a great deal of a rig's available work area. For example, large storage boxes, which must be loaded on and off a rig, take up a significant amount of space. Similarly, equipment used to move such cuttings from a rig's shale shaker to cuttings boxes can also take up a great deal of space. This additional equipment can present logistical and/or safety problems on many rigs.

Another problem associated with off-site disposal of drill cuttings is environmental impact. Such off-site disposal of drill cuttings does not necessarily guarantee an overall reduction or elimination of environmental contamination. Cuttings boxes must be transported to a rig, loaded with cuttings, and thereafter moved to an off-site storage facility. Trucks, vessels or other pollution-emitting means of transportation must typically be employed to transport said boxes to and from the rig. As a result, the overall impact on the environment of offsite disposal can be significant.

Attempts have been made to clean drill cuttings in order to remove surface contaminates prior to discharge of such cuttings into the environment. For example, certain cuttings recovery and treatment devices utilize separate cells having low speed agitators to stir a mixture of cuttings and cleansing surfactants. The cuttings are transferred from one cell to the next where additional agitation and cleansing takes place. Thereafter, a slurry of cleansed drill cuttings and surfactant is pumped from the cells to a vibrating screen operation in which most of the surfactant is removed and recovered for later use. In some cases, a portion of the surfactant solution, which is rich in fine drill cuttings and adherent drilling fluids, is run through one or more hydrocyclone separators which discharge the fine drill cuttings in solution separated from the larger, cleansed drill cuttings.

However, attempts at washing or otherwise treating drill cuttings on location have also proven to be problematic. Frequently, existing methods of washing drill cuttings require large amounts of equipment, which can cause space problems on most drilling rigs and add to the overall expense of a drilling project. Further, such cuttings washing systems utilize surfactants or other solutions which must be disposed of or, at a minimum, kept out of the surrounding environment. Perhaps most significantly, washed drill cuttings are seldom clean enough for discharge directly into the surrounding environment.

Accordingly, the need exists for a means to separate entrained and/or adherent fluids from fluids-laden drill cuttings. Said separation means should not take up a large amount of space on a drilling rig and should be easily adaptable with existing rig equipment. In areas in which on-site disposal is allowed, such separation means should remove sufficient amounts of fluids from fluids-laden drill cuttings to permit disposal of the solid components of said cuttings directly into the surrounding environment. In situations in which cuttings are stored in boxes or other means of transportation for off-site disposal, said separation means should remove enough entrained and/or adherent fluid from said cuttings to reduce the overall volume of the materials, thereby reducing the amount and/or size of the boxes needed to transport a given amount of cuttings. Additionally, there is a need for a means of separation which provides for the recovery and reclamation of fluids separated from such drill cuttings, particularly oil-based or synthetic-based drilling fluids.

It is, therefore, an object of the present invention to provide a means of removing fluids, and particularly entrained and/or adherent fluids, from drill cuttings.

It is further an object of the present invention to provide a means for recovering a greater percentage of drilling mud and other fluids from drill cuttings than existing separation methods.

It is yet another object of the present invention to provide a means of separating fluids from drill cuttings which utilizes a relatively small amount of equipment and, therefore, has minimal space requirements.

It is yet another object of the present invention to provide a means of separating fluids from drill cuttings which can easily integrate with existing rig equipment.

It is yet another object of the invention to provide a means of removing entrained and/or adherent fluids in drill cuttings being transported for off-site disposal, thereby making such transport more economical.

It is yet another object of the present invention to provide a means of separating sufficient amounts of entrained and/or adherent fluids from fluids-laden cuttings to permit efficient disposal of the solid components of said cuttings.

It is yet another object of the present invention to provide a means of separating entrained and/or adherent fluids from fluids-laden drill cuttings which permits the efficient reclamation and/or reuse of such separated fluids.

SUMMARY OF THE INVENTION

The present invention provides a method and apparatus for highly effective separation of fluids, such as drilling mud, mud additives and contaminants, from the solid components of oil well drill cuttings. Further, the present invention provides a method and apparatus for recovery of such separated fluids for re-use and/or disposal. Further still, the present invention is easily adaptable with existing rig equipment, and requires significantly less space than existing devices currently used to treat fluid-laden drill cuttings, and/or to separate fluids from such drill cuttings.

In the preferred embodiment, the present invention utilizes an elongate central member. Said elongate central member can take any number of shapes or outward configurations; however, in the preferred embodiment, said elongate central member is roughly in the shape of a cylinder. Further, said elongate central member is essentially hollow, resulting in said member having an inner bore extending therethrough. Said inner bore is oriented parallel to the longitudinal axis of said elongate central member.

One or more apertures extend through said elongate central member thereby effectively communicating the inner bore (and the inner surface) of said elongate central member with the outer surface of said elongate central member. It is conceivable that said elongate central member would take the form of a slotted liner, perforated tube or the like. However, in the preferred embodiment, said elongate central member is a cylindrical wire-wrapped screen. The gaps or spaces between the wire wrapping of such screen form an opening which allows communication from the outer surface to the inner bore/inner surface of said cylindrical screen.

Said wire-wrapped screen is positioned to receive fluids-laden drill cuttings containing entrained and/or adherent fluids on its outer surface. While said wire-wrapped screen can be positioned in any number of different locations, in the preferred embodiment said wire-wrapped screen is oriented near an outlet of a drilling rig shale shaker where fluids-laden cuttings exit said shale shaker. Said wire-wrapped screen is mounted so that its longitudinal axis is in a generally horizontal direction and transverse to the direction that fluids-laden drill cuttings exit said shale shaker.

Said wire-wrapped screen revolves or rotates about its longitudinal axis. In the preferred embodiment, a shaft is concentrically disposed within the inner bore of said cylindrical wire-wrapped screen. A plurality of baffles extend radially outward from said concentric shaft to the inner surface of said wire-wrapped screen, thereby forming a plurality of wedge-shaped compartments within the inner bore of said wire-wrapped screen.

A pressure differential is created between the outer and inner surfaces of said cylindrical wire-wrapped screen. Said pressure differential is created by application of suction pressure into the inner bore of said cylindrical wire-wrapped screen. In the preferred embodiment, a suction housing is affixed to an end of said cylindrical wire-wrapped screen. Said suction housing is connected to a vacuum source in order to impart suction pressure through said suction housing and into the inner bore of said cylindrical wire-wrapped screen.

Said suction housing must form a pressure seal with the end of said cylindrical wire-wrapped screen in order for the suction pressure to translate into the inner bore of said cylindrical wire-wrapped screen. Accordingly, the face of the suction housing which is immediately adjacent to one end of said cylindrical wire-wrapped screen must be capable of creating a pressure seal. In the preferred embodiment, said face of the suction housing is constructed of a suitable sealing material, such as an elastomer and/or ultra-high molecular weight plastic. Additionally, said suction housing is biased against the end of said cylindrical wire-wrapped screen to further facilitate said pressure seal.

For reasons described in detail below, it is beneficial to direct the suction toward the upper portion of said cylindrical wire-wrapped screen. Thus, a communication port is located near the upper end of the sealing face of said suction housing. When suction pressure is applied to said suction housing, the pressure drop (vacuum) is transferred to the inner bore of said cylindrical wire-wrapped screen through said communication port. However, because of said radial baffles, such suction is focused only into those internal wedge shaped compartment(s) which are immediately adjacent and open to the communication port in said suction housing. Because the communication port of the suction housing is near the top of said suction housing, application of the vacuum is limited to the upper portion of said cylindrical wire-wrapped screen.

Fluids-laden drill cuttings exit the shale shaker and are deposited on the outer surface of the cylindrical wire-wrapped screen. As the vacuum is applied to the inner bore of said cylindrical wire-wrapped screen, drilling mud and other fluids separate from the solid components of said drill cuttings and pass through the opening(s) of said cylindrical wire-wrapped screen. Because the solid components of the drill cuttings are too large to pass through said openings, such solids remain on the outer surface of said cylindrical screen. In essence, the cylindrical wire-wrapped screen serves as a filtering means to filter entrained and/or adherent fluids from said drill cuttings.

Suction pressure is specifically directed to the upper portions of said cylindrical wire-wrapped screen. Accordingly, fluid-laden drill cuttings placed upon the upper portion of the outer surface of said cylindrical screen will be exposed to suction pressure. However, as said cylindrical screen continues to rotate, suction pressure will not be transmitted to other portions of said cylindrical screen. Thus, the solid components of the cuttings which have been dried and are remaining on the outer surface of said screen will eventually roll off the face of said screen due to such rotation. In the preferred embodiment of the present invention, the speed of such rotation can be adjusted to optimize the retention time of said fluids-laden cuttings on the upper portion of the outer surface of said cylindrical wire-wrapped screen and, accordingly, the amount of exposure of said cuttings to suction pressure. Because drill cuttings from different wells, and/or drill cuttings generated by different drill bits, may consist of different types and/or sizes of solids, such drill cuttings may have different amounts of entrained and/or adherent fluids contained therein. As such, it may be desirable to adjust the rotational speed of said cylindrical wire-wrapped screen to ensure that said cuttings receive the ideal exposure to suction pressure in order to optimize fluid separation.

It is often beneficial to agitate fluids-laden drill cuttings deposited on the outer surface of said cylindrical wire-wrapped screen. In the preferred embodiment, a reciprocating scraper is positioned along the upper surface of said cylindrical wire-wrapped screen. Said reciprocating scraper moves in a path of travel parallel to the longitudinal axis of said cylindrical wire-wrapped screen. As fluids-laden drill cuttings are deposited on the upper portion of said cylindrical wire-wrapped screen, said reciprocating scraper even the piled cuttings, reducing the angle of repose and speeding the spreading of such cuttings over the upper surface of said cylindrical wire-wrapped screen. Said reciprocating scraper also helps to clear the surface of the cylindrical screen, thereby improving effectiveness of the fluid separation.

Fluids separated from said drill cuttings are piped away from the inner bore of said cylindrical wire-wrapped screen. Said fluids are directed into the active mud system for re-use or, alternatively, to separate facilities for storage and/or disposal. Similarly, the dried solids remaining from the drill cuttings roll off said rotating cylindrical wire-wrapped screen. Said solid components can be disposed of on location or, if preferred, collected for transportation and off-site disposal.

DETAILED DESCRIPTION OF A PREFERRED EMBODIMENT

Figure 1:
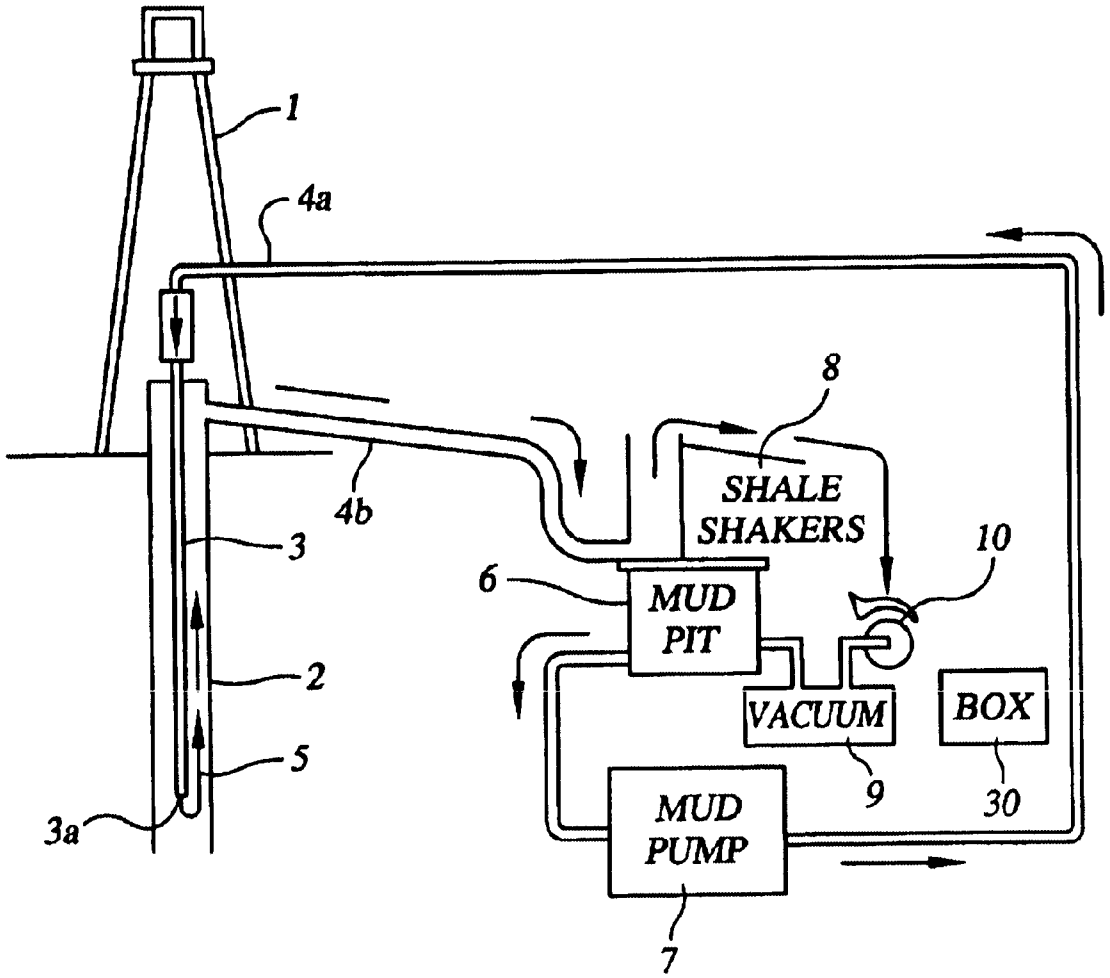
FIG. 1 is a schematic view of a mud system of drilling rig, including the present invention.

Referring to the drawings, FIG. 1 depicts a schematic overview representation of the mud system of a typical drilling rig. The flow of drilling mud within this mud system in FIG. 1 is in the direction of the arrows.

Still referring to FIG. 1, derrick 1 extends vertically over wellbore 2. Tubular work string 3 is inserted into wellbore 2, and extends from the earth's surface to a desired depth within said wellbore 2. Flow line 4*a* is connected to said tubular work string 3. Flow line 4*b* is connected to annular space 5 formed between the outer surface of tubular work string 3 and the inner surface of wellbore 2.

Still referring to FIG. 1, the bulk of the drilling mud for the depicted mud system is in mud pit 6. Mud from said mud pit 6 is circulated through the overall mud system depicted schematically in FIG. 1 via mud pump 7. The mud is pumped into tubular work string 3 through flow line 4*a*, circulated out the end 3*a* of tubing 3 up the annulus 5 of wellbore 2, and out of said wellbore annulus via flow line 4*b*.

During drilling operations, mud exiting the wellbore annulus through flow line 4*b* often includes drill cuttings and other debris from the wellbore. Such drill cuttings and other debris would contaminate the overall quality of the mud if allowed to simply remain in the active mud system. Accordingly, the mud and drill cuttings mixture leaving the well is directed to shale shakers 8. As the combined mixture of drilling mud and drill cuttings are directed over shale shakers 8, much of the "free" liquid mud passes through the screens of said shale shakers 8 and into mud pit 6. Drill cuttings, frequently containing entrained and/or adherent fluids, pass over said shale shakers 8 and are thereafter discharged from said shale shakers.

Fluid-laden drill cuttings discharged from shale shakers 8 cannot simply be re-introduced into the active mud system. Accordingly, such drill cuttings must be treated and/or disposed of properly. In many cases, it is possible to collect such drill cuttings for transportation and eventual disposal. However, for the reasons discussed in detail above, it is frequently beneficial to separate entrained and/or adherent drilling muds and other fluids from said cuttings on location.

FIG. 1 depicts the separation apparatus of the present invention, 10, installed downstream of said shale shakers 8. As fluid-laden drill cuttings exit shale shakers 8 and pass onto separation apparatus 10, fluids are suctioned away from the solid components of said drill cuttings and returned to mud pit 6 using vacuum 9. Depending on the drilling environment in question, fluids other than drilling mud may be recovered in this process. Accordingly, although not specifically depicted in FIG. 1, it is possible to include additional conventional separation means to remove contaminants from the recovered drilling mud prior to returning such mud to the bulk mud system in mud pit 6.

Dried solids, typically comprised of drilled-up pieces of rock and other debris originating from wellbore 2, pass over separation apparatus 10. Such solids can be directed to collection box 30 for storage or eventual transportation to an off-site disposal facility. Alternatively, depending upon environmental and/or other regulatory compliance issues, said dried cuttings can be disposed of on site. For example, assuming applicable regulations are satisfied, such dried cuttings may be released directly into the surrounding environment.

Figure 2:
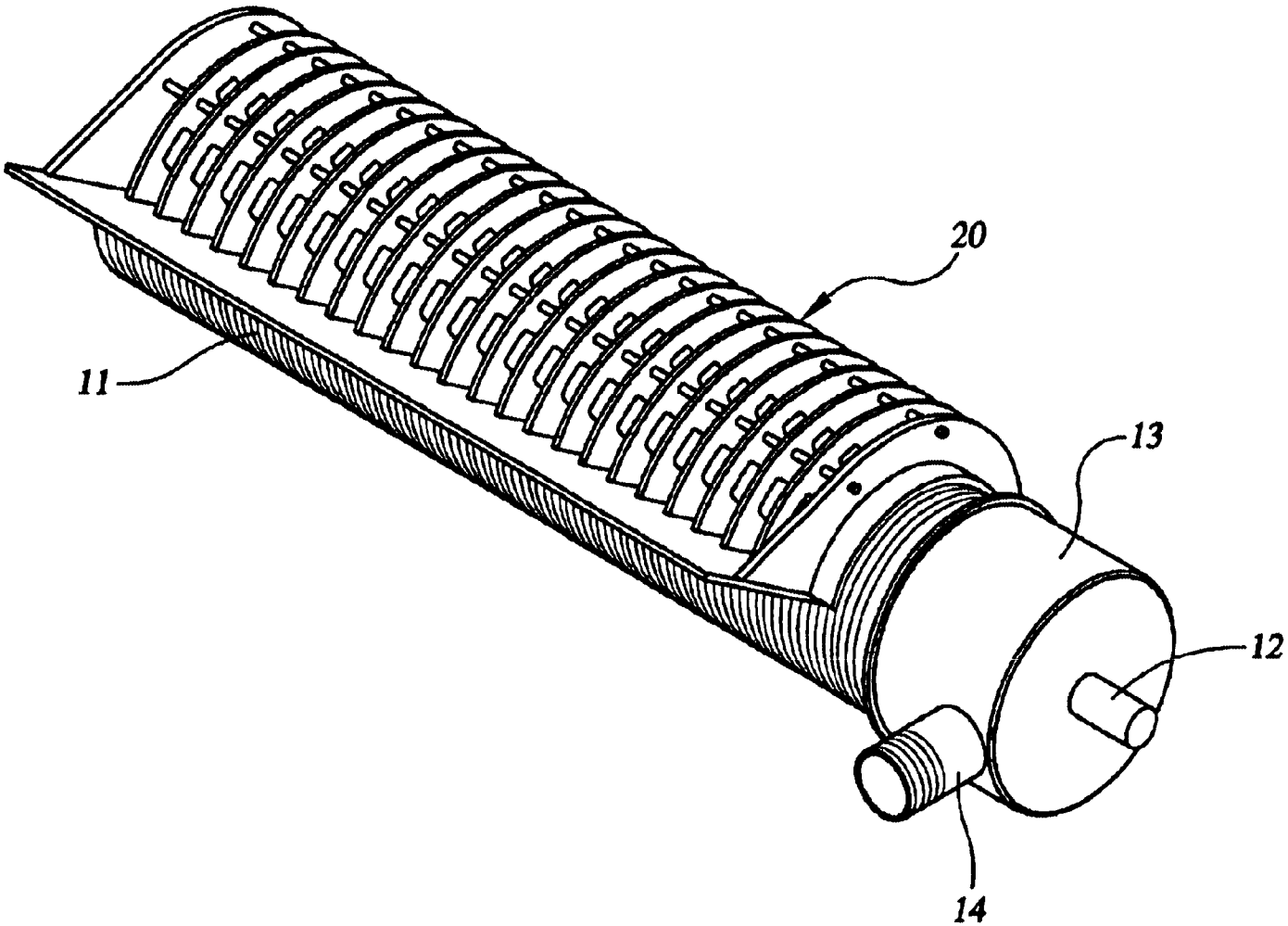
FIG. 2 is a perspective view of the apparatus of the present invention.

FIG. 2 depicts a perspective view of certain components of the preferred embodiment of the fluid separation apparatus 10 of the present invention. Roughly cylindrical wire-wrapped screen 11 is positioned so that its longitudinal axis is oriented in a generally horizontal direction. Cylindrical wire-wrapped screen 11 is hollow; drive shaft 12 is concentrically disposed within the longitudinal bore of said cylindrical screen 11. Suction housing 13 having outlet line 14 is installed on at least one end of said cylindrical wire-wrapped screen 11. Scraping member 20 is slidably disposed along the upper portion of the outer surface of cylindrical wire-wrapped screen 11.

Figure 3:
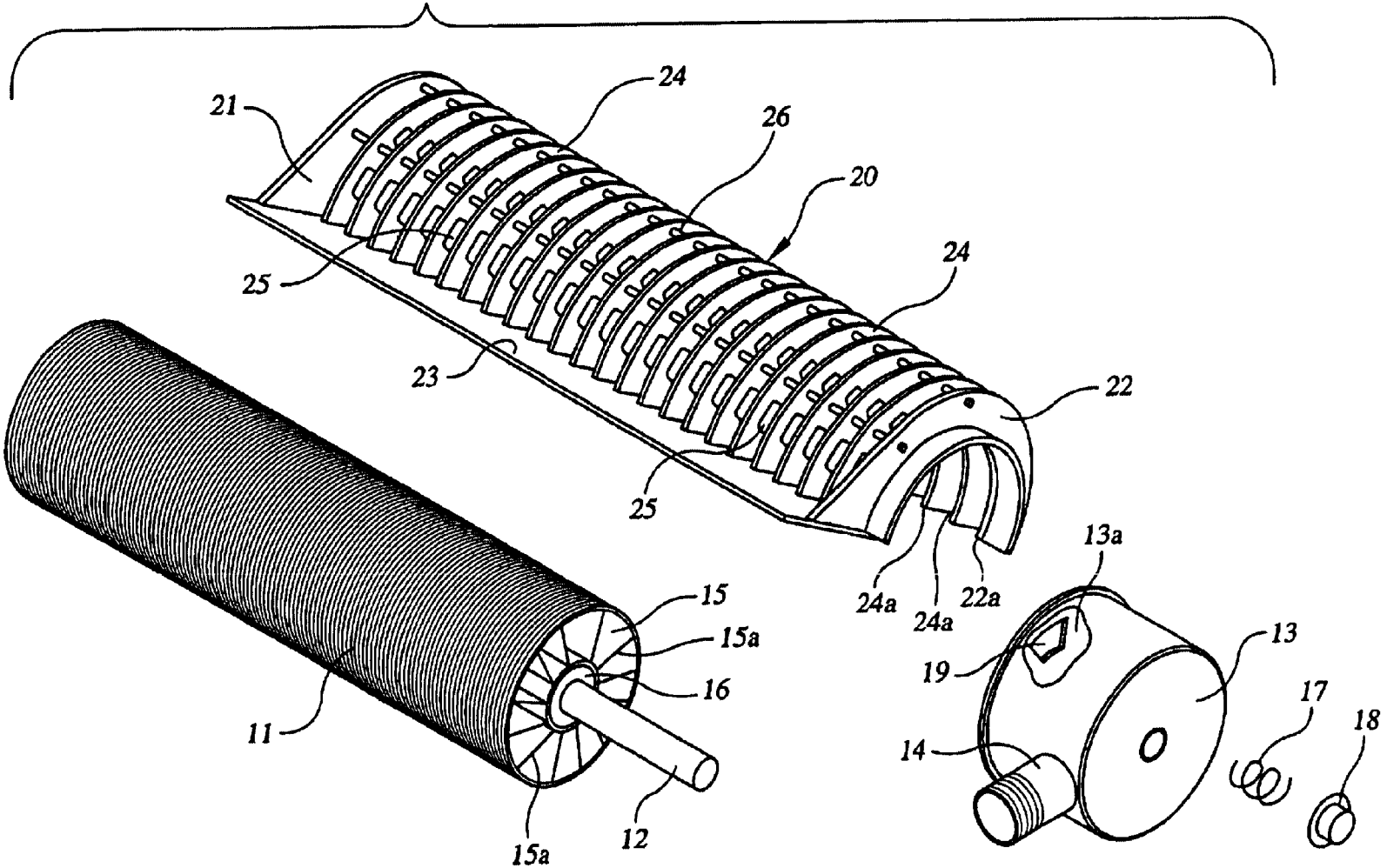
FIG. 3 is an exploded perspective view of the components of the present invention depicted in FIG. 2.

FIG. 3 depicts an exploded perspective view of the components of the preferred embodiment of the present invention illustrated in FIG. 2. Horizontally oriented drive shaft 12 is concentrically disposed within the longitudinal bore of hollow, cylindrical wire-wrapped screen 11. A plurality of baffles 15 extend radially outward from drive shaft 12. In FIG. 3, a bushing 16 is depicted on said drive shaft. Baffles 15 extend outward from said bushing to the inner surface of said cylindrical wire-wrapped screen 11 and create a plurality of wedge-shaped compartments within said cylindrical wire-wrapped screen 11.

Suction housing 13 is received on drive shaft 12 and is positioned immediately adjacent to a lateral end of cylindrical wire-wrapped screen 11. Outlet line 14 extends from said suction housing 13. In the preferred embodiment of the present invention, outlet line 14 is threaded for connection with a flow line (not shown).

Inner face 13*a* of suction housing is constructed of sealable material. When suction housing 13 is installed on drive shaft 12, inner face 13*a* of suction housing 13 forms a pressure seal with terminal edges 15*a* of baffles 15. This pressure seal remains intact even when cylindrical wire-wrapped screen 11 is rotated. Although any number of non-abrasive materials can be used for providing such a pressure seal, in the preferred embodiment of the present invention inner face 13*a* of suction housing 13 is constructed of a durable elastomer such as ultra high molecular weight plastic or the like. In order to facilitate this pressure seal, compression spring 17 and lock-down bracket 18 can be used to bias suction housing 13, and thus inner face 13*a* of said suction housing 13, against terminal edges 15*a* of baffles 15. Inner face 13*a* of suction housing 13 has opening 19 to permit pressure communication between suction housing 13 and the inner bore of cylindrical wire-wrapped screen 11.

Scraping member 20 is generally disposed along the upper surface of cylindrical wire-wrapped screen 11. In the preferred embodiment of the present invention, scraping member 20 is comprised of end plates 21 and 22. End plate 22 includes a concave or curved cut-out 22*a* which is slightly larger than the circumference of cylindrical wire-wrapped screen 11. End plate 21 likewise includes a curved opening similar to 22*a*; however, said opening is obscured from view in FIG. 3. Apron plate 23 extends between end plates 21 and 22, and forms a trough-like surface. A plurality of intermediate plate members 24 are disposed between end plates 21 and 22 at desired intervals along scraping member 20. Said intermediate plate members 24 also include curved cut-outs 24*a* which generally conform to the curvature of wire-wrapped screen 11. Said intermediate plate members 24 include communication bores 25, and are anchored in place with anchor rods 26.

Figure 4:
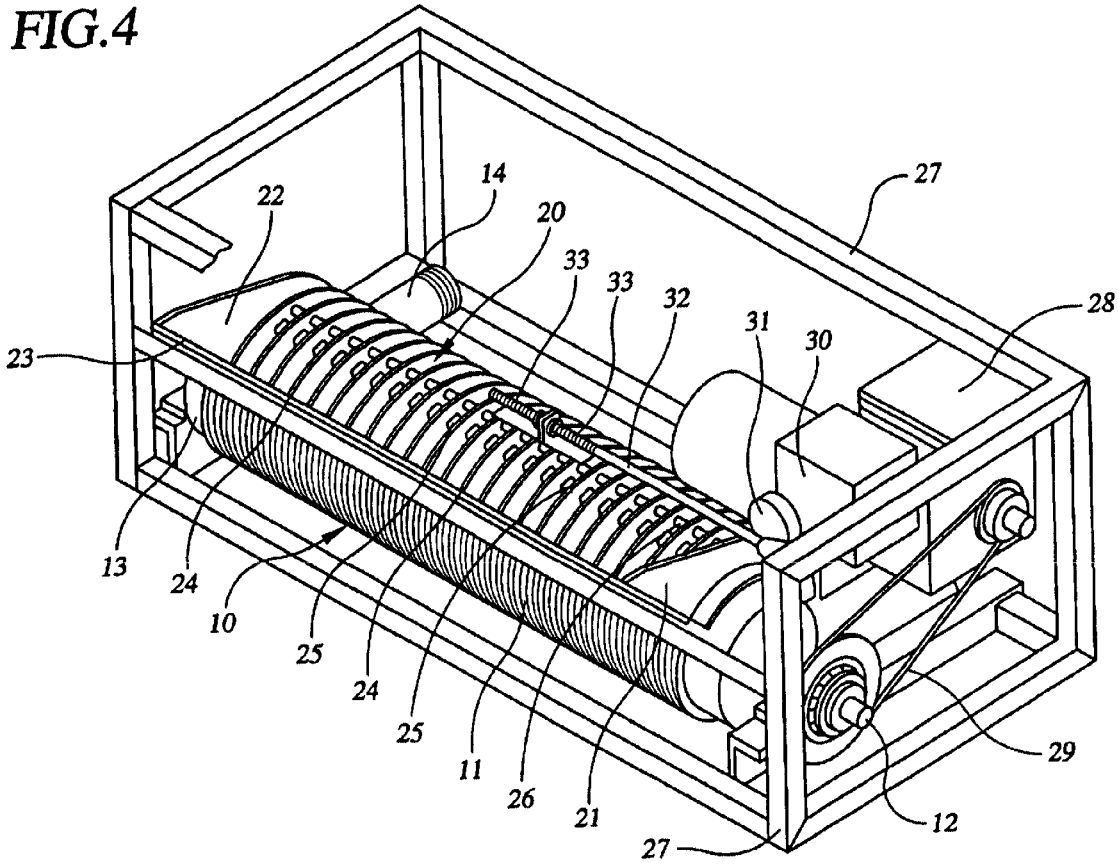
FIG. 4 is a perspective view of a preferred embodiment of the present invention.

Referring to FIG. 4, a perspective view of a preferred embodiment of the fluid separation apparatus 10 of the present invention is depicted. Roughly cylindrical wire-wrapped screen 11 is positioned so that its longitudinal axis is oriented in a generally horizontal direction. Cylindrical wire-wrapped screen 11 is hollow; drive shaft 12 is concentrically disposed within the longitudinal bore of said cylindrical screen 11. Suction housing 13 having outlet line 14 is installed at one end of said cylindrical wire-wrapped screen 11. Scraping member 20 is slidably disposed along the upper portion of the outer surface of cylindrical wire-wrapped screen 11.

Scraping member 20 is comprised of end plates 21 and 22. Apron plate 23 extends between end plates 21 and 22, and forms a trough-like surface or structure. A plurality of intermediate plate members 24 are disposed between end plates 21 and 22 at desired intervals along scraping member 20. Said intermediate plate members 24 also include communication bores 25, and are anchored in place with anchor rod 26.

In the preferred embodiment, the apparatus of the present invention is included within frame 27, which promotes ease of transportation and installation of said apparatus on a drilling rig location. Motor 28 is mounted within frame 27. Drive belt 29 is used to impart torque from motor 28 to drive shaft 12, thereby causing said drive shaft 12 and cylindrical wire-wrapped screen 11 to rotate about their longitudinal axes. Although depicted as a flexible belt, drive belt 29 could be replaced with a chain or other means for transferring torque from motor 28 to drive shaft 12. Motor 28 and can also be used in connection with gear mechanism 30 to drive scraping member 20. In the preferred embodiment, gear mechanism includes eccentric gear 31, which is used to drive oscillation shaft 32. Oscillation shaft 32 in turn drives scraping member 20 in a reciprocating motion parallel to the longitudinal axis of cylindrical wire-wrapped screen 11. Compression springs 33 provide play for said oscillation shaft 32 in the event that an obstruction or large clump of cuttings is encountered by said scraping member 20.

In operation, fluids-laden drill cuttings exit a rig's shale shaker and are deposited on the trough-like surface formed by apron plate 23 of scraping member 20 and, ultimately, onto outer surface of the cylindrical wire-wrapped screen 11. As a vacuum is applied to outlet line 14 of suction housing 13, suction pressure is communicated to the inner bore of said cylindrical wire-wrapped screen 11 via opening 19 of suction housing 13. Such suction pressure is ultimately applied to fluid-laden drill cuttings deposited on the outer surface of cylindrical wire-wrapped screen 11 via aperture(s) extending through said screen.

Drilling mud and other fluids separate from the solid components of said drill cuttings and pass through the aperture(s) of said cylindrical wire-wrapped screen 11. Because the solid components of the drill cuttings are too large to pass through said aperture(s), such solids remain on the outer surface of said cylindrical screen 11. In essence, said cylindrical wire-wrapped screen 11 serves as a filtering means to filter entrained and/or adherent fluids which are suctioned from said drill cuttings.

Suction pressure is specifically directed to and focused on the upper portions of said cylindrical wire-wrapped screen 11 where fluids-laden cuttings are deposited. When suction pressure is applied to said suction housing 13, the pressure drop (vacuum) is transferred to the inner bore of said cylindrical wire-wrapped screen 11 through opening 19 of suction housing 13. However, because of radial baffles 15, such suction pressure is focused into only those internal wedge shaped compartment(s) within the inner bore of cylindrical wire-wrapped screen 11 which are immediately adjacent to and in communication with opening 19 in suction housing 13. Further, because opening 19 of suction housing 13 is beneficially positioned near the upper portion of said suction housing 13 and inner face 13*a*, application of the vacuum is therefor limited to the upper portion of said cylindrical wire-wrapped screen 11. Accordingly, fluid-laden drill cuttings placed upon the upper portion of the outer surface of said cylindrical wire-wrapped screen 11 will be exposed to suction pressure.

As drive shaft 12 is turned and cylindrical wire-wrapped screen 11 is rotated about its longitudinal axis, suction pressure will not be transmitted to other portions of said cylindrical screen which are not in pressure communication with suction housing 13. Thus, any solid components of drill cuttings which have previously been separated from entrained and/or adherent fluids, but are remaining on the outer surface of said cylindrical wire-wrapped screen, will not be exposed to suction pressure and will eventually roll off the outer surface of said cylindrical wire-wrapped screen due to such rotation.

In the preferred embodiment of the present invention, the rotational speed of cylindrical wire-wrapped screen 11 can be adjusted to optimize the retention time of fluids-laden drill cuttings on the upper portion of the outer surface of said cylindrical wire-wrapped screen 11 and, accordingly, the amount of exposure of said cuttings to suction pressure. Because drill cuttings from different wells, and/or drill cuttings generated by different drill bits, may consist of different types and/or sizes of solids, such drill cuttings may have different amounts of entrained and/or adherent fluids contained therein. As such, it may be desirable to adjust the rotational speed of said cylindrical wire-wrapped screen 11 to ensure that said cuttings receive the ideal exposure to suction pressure in order to optimize fluid separation.

It is often beneficial to agitate fluids-laden drill cuttings deposited on the outer surface of said cylindrical wire-wrapped screen 11. In the preferred embodiment, reciprocating scraping member 20 is positioned along the upper surface of said cylindrical wire-wrapped screen 11. Said reciprocating scraper moves in a path of travel parallel to the longitudinal axis of said cylindrical wire-wrapped screen 11. As fluids-laden drill cuttings are deposited on the trough-like surface formed by apron plate 23 and the upper portion of said cylindrical wire-wrapped screen 11, said reciprocating scraper evens the piled cuttings, reducing the angle of repose and speeding the spreading of such cuttings over the upper surface of said cylindrical wire-wrapped screen 11. Said reciprocating scraping member 20 also helps to clean the surface of the cylindrical screen 11, thereby improving effectiveness of the fluid separation process. Intermediate plate members 24 of scraping member 20 help to break up and/or evenly distribute such deposited cuttings. Communication bores 25 in intermediate plate members 24 permit piled cuttings to pass between said intermediate plate members to help facilitate even distribution of deposited drill cuttings.

Suctioned fluids separated from the solid components of drill cuttings are piped away from the inner bore of said cylindrical wire-wrapped screen 11. Said fluids enter the wedge shaped compartments within the inner bore of wire-wrapped screen 11 formed by radial baffles 15, and pass (via opening 19) into suction housing 13. Said fluids are evacuated from suction housing 13 via outlet line 14 and ultimately directed into the active mud system for re-use or, alternatively, to separate facilities for storage and/or disposal. Similarly, the dried solids remaining on the outer surface of cylindrical wire-wrapped screen 11 from the previously fluid-laden drill cuttings will generally roll off said rotating cylindrical wire-wrapped screen. Said solid components can be disposed of on location or, if preferred, collected for transportation and off-site disposal.

Although preferred embodiments of the subject invention have been described herein, it should be understood that various changes, adaptations and modifications may be made therein without departing from the spirit of the invention and the scope of the appended claims.

What is claimed is:

1. A method of separating entrained or adherent fluids from drill cuttings comprising:

a. providing a substantially hollow elongate member having an inner surface, an outer surface and one or more apertures extending from said inner surface to said outer surface;

b. rotating said elongate member about its longitudinal axis;

c. depositing drill cuttings on the outer surface of said elongate member; and d. creating a pressure differential across said elongate member drawing fluids from said drill cuttings through said one or more apertures of said elongate member and leaving solids on the outer surface of said elongate member.

2. The method of claim 1, further comprising the step of agitating said drill cuttings on the outer surface of said elongate member.

3. The method of claim 1, wherein said pressure differential is created by applying suction through the inside of said substantially hollow elongate member.

4. The method of claim 3, further comprising:

a. evacuating said fluids from the inside of said substantially hollow elongate member; and b. delivering said fluids away from said elongate member.

5. The method of claim 4, further comprising:

a. removing solids from the outer surface of said elongate member; and b. collecting said solids.

6. The method of claim 4 further comprising the step of disposing of said solids.

7. A method of separating entrained or adherent fluids from drill cuttings comprising:

a. providing a substantially hollow cylindrical member having an inner surface, an outer surface and one or more apertures extending from said inner surface to said outer surface;

b. rotating said cylindrical member about its longitudinal axis;

c. depositing drill cuttings on the outer surface of said cylindrical member; and d. creating a pressure differential across said cylindrical member drawing fluids from said drill cuttings through said one or more apertures of said cylindrical member and leaving solids on the outer surface of said cylindrical member.

8. The method of claim 7, further comprising the step of agitating said drill cuttings on the outer surface of said cylindrical member.

9. The method of claim 7, wherein said pressure differential is created by applying suction through the inside of said roughly substantially hollow cylindrical member.

10. The method of claim 9, further comprising:

a. evacuating said fluids from the inside of said substantially hollow cylindrical member; and b. delivering said fluids away from said cylindrical member.

11. The method of claim 10, further comprising:

a. removing solids from the outer surface of said cylindrical member; and b. collecting said solids.

12. The method of claim 10 further comprising the step of disposing of solids from the outer surface of said cylindrical member.

13. An apparatus for separating entrained or adherent fluids from drill cuttings comprising:

a. an elongate member having an inner surface, an outer surface and one or more apertures extending from said inner surface to said outer surface;

b. a shaft concentrically disposed within said elongate member;

c. a plurality of baffles extending radially outward from said shaft to the inner surface of said elongate member;

d. means for rotating said elongate member about its longitudinal axis; and e. means for creating a pressure differential across one or more apertures in said elongate member.

14. The apparatus of claim 13, further comprising means for agitating cuttings deposited on the outer surface of said elongate member.

15. The apparatus of claim 14, wherein said means for agitating cuttings on the outer surface of said elongate member is a reciprocating member.

16. The apparatus of claim 15, wherein said reciprocating member has a path of travel which is parallel to the longitudinal axis of said elongate member.

17. The apparatus of claim 13, wherein said means for rotating said elongate member is a motor attached to said shaft.

18. The apparatus of claim 13, wherein said means for creating a pressure differential across one or more apertures in said elongate member further comprises:

a. a box member mounted immediately adjacent to one end of said elongate member, wherein said box member has a sealing element which forms a pressure seal with adjacent ends of said baffles;

b. an inlet for applying suction to said box member; and c. a port extending through said sealing element to communicate said box member with the inside of said elongate member.

19. An apparatus for separating liquids from drill cuttings comprising:

a. a cylindrical screen having an inner surface and an outer surface;

b. a shaft concentrically disposed within said cylindrical screen;

c. a plurality of baffles extending radially outward from said shaft to the inner surface of said screen;

d. means for rotating said cylindrical screen about its longitudinal axis; and e. means for creating a pressure differential across said cylindrical screen.

20. The apparatus of claim 19, further comprising means for agitating cuttings deposited on the outer surface of said cylindrical screen.

21. The apparatus of claim 20, wherein said means for agitating cuttings on the outer surface of said cylindrical screen is a reciprocating member.

22. The apparatus of claim 21, wherein said reciprocating member has a path of travel which is parallel to the longitudinal axis of said cylindrical screen.

23. The apparatus of claim 19, wherein said means for rotating said cylindrical screen is a motor attached to said shaft.

24. The apparatus of claim 19, wherein said means for creating a pressure differential across said cylindrical screen further comprises:

a. a box member mounted immediately adjacent to one end of said cylindrical screen, wherein said box member has a sealing element which forms a pressure seal with the adjacent ends of said baffles;

b. an inlet for applying suction to said box member; and c. a port extending through said sealing element to communicate said box member with the inside of said cylindrical screen.

25. A method of treating drill cuttings and reclaiming drilling fluids comprising:

a. receiving drill cuttings directly from a shale shaker without a conveyor;

b. separating entrained or adherent fluids from said drill cuttings proximate to said shale shaker; and c. collecting said separated fluids.

26. The method of claim 25, further comprising commingling said separated fluids with fluids in an active mud system of a drilling rig.

27. The method of claim 25, further comprising disposing of residual solids from said drill cuttings.

28. A method of separating entrained or adherent fluids from drill cuttings comprising:

a. depositing drill cuttings on a screen;

b. agitating said drill cuttings on said screen; and c. simultaneously creating a pressure differential across said screen to draw fluids from said drill cuttings through said screen.

29. The method of claim 28, wherein said pressure differential is created by applying suction below said screen.

30. The method of claim 28, further comprising removing substantially dry solids from said screen.

31. The method of claim 29, further comprising disposing of said substantially dry solids.

32. The method of claim 29, further comprising collecting fluids separated from said drill cuttings.

33. The method of claim 32, further comprising transporting said separated fluids away from said screen.

34. The method of claim 33, further comprising commingling said separated fluids with an active mud system of a drilling rig.

35. A method of separating entrained or adherent fluids from drill cuttings comprising:

a. depositing drill cuttings exiting a shale shaker on a screen;

b. raking said drill cuttings on said screen along an axis which is substantially perpendicular to the flow path of said drill cuttings exiting said shale shaker; and c. simultaneously creating a pressure differential across said screen to draw fluids from said drill cuttings through said screen.

36. The method of claim 35, wherein said pressure differential is created by applying suction below said screen.

37. The method of claim 35, further comprising removing substantially dry solids from said screen.

38. The method of claim 37, further comprising disposing of said substantially dry solids.

39. The method of claim 35, further comprising collecting fluids separated from said drill cuttings.

40. The method of claim 39, further comprising transporting said fluids away from said screen.

* * * * *